US009221274B2

(12) United States Patent
Kraus

(10) Patent No.: US 9,221,274 B2
(45) Date of Patent: Dec. 29, 2015

(54) DIRECT PRINTING METHOD FOR PRINTING A COVER LAYER ONTO CONTAINERS

(71) Applicant: KRONES AG, Neutraubling (DE)

(72) Inventor: Andreas Kraus, Lappersdorf (DE)

(73) Assignee: KRONES AG, Neutraubling (DE)

( * ) Notice: Subject to any disclaimer, the term of this patent is extended or adjusted under 35 U.S.C. 154(b) by 0 days.

(21) Appl. No.: 14/185,046

(22) Filed: Feb. 20, 2014

(65) Prior Publication Data

US 2014/0320574 A1 Oct. 30, 2014

(30) Foreign Application Priority Data

Apr. 29, 2013 (DE) ..... 10 2013 207 799

(51) Int. Cl.

| | |
|---|---|
| ***B41J 2/00*** | (2006.01) |
| ***B41J 3/407*** | (2006.01) |
| ***B41J 11/00*** | (2006.01) |
| *B41M 5/00* | (2006.01) |
| *B41M 7/00* | (2006.01) |

(52) U.S. Cl.

CPC ..... *B41J 3/407* (2013.01); *B41J 3/4073* (2013.01); *B41J 11/0015* (2013.01); *B41M 5/0088* (2013.01); *B41M 7/0045* (2013.01); *B41M 7/0054* (2013.01); *B41M 5/0047* (2013.01); *B41M 7/0009* (2013.01)

(58) Field of Classification Search

CPC ..... B41J 11/0015; B41J 2/2114; B41M 7/00; B41M 7/0009; B41M 7/0027; B41M 7/0036; B41M 7/0045; B41M 7/0054

USPC ..... 347/110

See application file for complete search history.

(56) References Cited

U.S. PATENT DOCUMENTS 5,851,306 A * 12/1998 Robichon ..... 134/22.1
6,147,041 A 11/2000 Takahashi et al.

(Continued)

FOREIGN PATENT DOCUMENTS

CN 102785476 A 11/2012
DE 2558312 A1 7/1977

(Continued)

OTHER PUBLICATIONS

Search report for DE 10 2013 207 799.8, dated Sep. 24, 2013.

(Continued)

*Primary Examiner* — Jannelle M Lebron
*Assistant Examiner* — Jeremy Bishop
(74) *Attorney, Agent, or Firm* — Marshall, Gerstein & Borun LLP

(57) ABSTRACT

Method for direct printing on containers via a direct printing machine, with a print layer printed onto the container, in a first predefined area, in a first device, and a cover layer applied to the container in a second device, the cover layer applied to a second predefined area. A surface area of the second predefined area is larger than that of the first predefined area. The cover layer coalesces with the printing ink in the first predefined area, creating a first connection, and coalesces with the container in parts of the second predefined area differing from the first predefined area, creating a second connection. The first and second connections are insoluble in aqueous solutions having a pH value between 3 and 10 and easily soluble in aqueous solutions having a pH value in a range of less than 3 and/or higher than 10.

14 Claims, 3 Drawing Sheets

(56) References Cited

U.S. PATENT DOCUMENTS

| | | | | |
|---|---|---|---|---|
| 6,210,776 | B1 * | 4/2001 | Hill | 428/187 |
| 8,020,359 | B2 * | 9/2011 | Mattos et al. | 53/411 |
| 8,169,657 | B2 * | 5/2012 | Wang et al. | 358/1.5 |
| 8,267,507 | B2 * | 9/2012 | Mitsuzawa | B41J 2/2114 347/102 |
| 8,424,993 | B2 * | 4/2013 | Ikehata | B41J 2/2114 347/101 |
| 8,593,681 | B2 * | 11/2013 | Iguchi | G06K 15/02 358/1.18 |
| 2006/0250464 | A1 * | 11/2006 | Sheinman | 347/101 |
| 2010/0281833 | A1 | 11/2010 | Mattos, Jr. et al. | |
| 2012/0120142 | A1 * | 5/2012 | Tom et al. | 347/15 |
| 2012/0293593 | A1 * | 11/2012 | Kondo et al. | 347/102 |
| 2013/0157826 | A1 * | 6/2013 | Preckel et al. | 493/53 |

FOREIGN PATENT DOCUMENTS

| | | | |
|---|---|---|---|
| DE | 102010044243 | A1 | 3/2012 |
| EP | 0930237 | A2 | 7/1999 |
| WO | WO-9852700 | A1 | 11/1998 |
| WO | WO-2005/025873 | A2 | 3/2005 |
| WO | WO-2009018892 | A1 | 2/2009 |
| WO | WO-2010/034375 | A1 | 4/2010 |
| WO | WO-2010132149 | A1 | 11/2010 |
| WO | WO-2012003186 | A1 | 1/2012 |

OTHER PUBLICATIONS

Search Report for Application EP14151862.1, dated Nov. 5, 2014.
The First Office Action, The State Intellectual Property of the People's Republic of China, Application No. 201410135581.X, dated Nov. 3, 2015.

* cited by examiner

DIRECT PRINTING METHOD FOR PRINTING A COVER LAYER ONTO CONTAINERS

CROSS-REFERENCE TO RELATED APPLICATION

The present application claims the benefit of priority of German Application No. 10 2013 207 799.8, filed Apr. 29, 2013. The application is incorporated herein by reference in its entirety.

FIELD OF THE DISCLOSURE

The disclosure relates to a direct printing method and a corresponding direct printing machine for printing different layers onto containers, such as bottles.

BACKGROUND

Printing on containers, such as bottles, is known from the prior art to a sufficient extent. Also the use of a plurality of print layers is disclosed e.g. in DE 10 2010 044 243 A1, where an intermediate or base layer is provided, which is first applied to the container surface, whereupon the print layer is applied to this base layer. Physical properties, such as adhesion strength and migration properties, are determined by the respective parameters between the print layer and the intermediate layer on one hand and the intermediate layer and the container surface on the other.

SUMMARY OF THE DISCLOSURE

Taking this prior art as a basis, it is one aspect of the present disclosure to improve existing direct printing methods, in particular with respect to the recyclability of the products produced by this method.

The direct printing method according to the present disclosure used for printing on containers, such as bottles, with the aid of a direct printing machine by which a print layer is printed onto the container, at least in a first predefined area thereof, in a first device in a first step and a cover layer is applied to the container in a second device in a second step, the cover layer being applied to a second predefined area, which comprises the first predefined area and the surface area of which is larger than that of the first predefined area, the cover layer coalescing with the printing ink in the first predefined area thus creating a first connection, the cover layer coalescing with the container in parts of the second predefined area which differ from the first predefined area thus creating a second connection, and the first and second connections being insoluble in first aqueous solutions having a pH value between 3 and 10 and easily soluble in second aqueous solutions having a pH value in a range of less than 3 and/or higher than 10. Through this cover layer the printing ink can, on the one hand, be fixed to the surface of the container without having to adhere strongly to the container and, on the other hand, the print layer is thus protected against environmental influences, such as scratches or the like. Furthermore, the recycling properties of the printed containers are improved, since the fact that the cover layer is soluble in basic solutions facilitates the separation of the underlying print layer from the container.

According to one embodiment, the direct printing method includes that the cover layer is applied to the second area with the aid of a rolling device or a flushing device or a spraying device or a dipping device or a direct printing device or a plasma coating device or a flame pyrolysis device. Due to these manifold possibilities of applying the cover layer, flexible methods for applying the cover layer are available, in particular as regards the shape that can be produced as well as specific properties of the cover layer.

According to a further embodiment, the direct printing method includes that the cover layer is easily soluble in the second aqueous solutions at a temperature of at least 70° C. The solubility of the cover layer, in particular at high temperatures, substantially improves the recyclability of a container that has been printed on in this way, since in normal scrubbing solutions the pH value is significantly lower than 3 or higher than 10 on the one hand and the temperature often lies in the range between 70 and 100° C. on the other. An advantageous aspect is here that only the cover layer must have these properties with respect to solubility. The print layer or the print layers need not have these properties and, consequently, the materials used for the print layers can be provided more easily.

Furthermore, the print layer according to the present disclosure may easily be soluble in the second aqueous solutions. The result is that not only the cover layer can be detached during a recycling process but also the print layer can be removed in the aqueous solution used.

Moreover, the second predefined area and the first predefined area may be geometrically similar. A cover layer applied in such an accurate fashion reduces the cost of material and is more eco-friendly and more ecological.

According to one embodiment, the distance of a point on the edge of the first predefined area to the edge of the second predefined area is identical for any point on the edge of the first predefined area. The result is that the print layer is uniformly enclosed by the cover layer on all sides and that weak points, which might already occur during the production process, will be avoided.

In addition, the material of the cover layer may, when exposed to radiation of a specific wavelength, react with a change of at least one of the properties adhesion strength, color, barrier properties, migration properties, the container being irradiated with radiation of this specific wavelength with the aid of an irradiation unit arranged downstream of the second device, when seen in the conveying direction. The containers printed on can thus be provided with cover layers having specific properties, which exceed an improved recyclability. For example, the cover layer may thus have specific optical characteristics or specific degrees of hardness.

According to one embodiment, the cover layer is applied to the container depending on sensor data indicative of the geometrical shape of the print layer. Making use of the respective sensor data, the cover layers can be applied to each container in a customized manner, and this can contribute to further economization and to a more eco-friendly and more ecological recycling.

According to a further embodiment, at least one further print layer is applied to a third predefined area between the first step in the second step, the third predefined area being at least partially congruent with the first predefined area, or the third predefined area being different from the first predefined area, the first and the third predefined areas defining a printed region and the second predefined area comprising the printed region and the surface area of the second predefined area being larger than the printed region. A direct printing machine having this kind of structural design can apply a cover layer to a container that has already been printed on, said cover layer being able to protect the print layer against environmental influences.

In addition, a direct printing machine is provided for printing on containers such as bottles, the direct printing machine comprising a conveyor device for conveying the containers through the printing machine along a conveying direction, a first device for applying a print layer to a first predefined area of the container and a second device for applying a cover layer to a second predefined area of the container, the first device being arranged upstream of the second device when seen in the conveying direction, characterized in that the second device is suitable for applying the cover layer to the second predefined area, the second predefined area comprising the first predefined area and the second predefined area being larger than the first predefined area. Depending on process parameters and on the demands to be satisfied by the cover layer, the use of one or more of these devices for applying the cover layer may be of advantage. The printing machines in question may be configured as linear-type or carousel-type machines.

In the direct printing machine, the second device may comprise a rolling device or a flushing device or a spraying device or a dipping device or a direct printing device or a plasma coating device or a flame pyrolysis device, said devices being capable of applying the cover layer. Depending on process parameters and on the demands to be satisfied by the cover layer, the use of one or more of these devices for applying the cover layer may be of advantage.

In addition, the direct printing machine may comprise an irradiation unit arranged downstream of the second device when seen in the conveying direction, said irradiation unit being capable of emitting radiation in a specific wavelength region and the material of the cover layer reacting to an irradiation with radiation in this specific wavelength region. When the cover layer is irradiated in this way, it can have imparted thereto special characteristics such as a specific degree of hardness/dryness or optical characteristics.

According to a further embodiment, the direct printing machine includes a sensor, which is arranged downstream of the first device and upstream of the second device when seen in the conveying direction and which is capable of measuring the geometrical shape of the print layer and of transmitting to a data processing unit a signal indicative of the geometrical shape of the print layer, the data processing unit being capable of generating a signal for controlling the second device, the signal being indicative of the second predefined area and the second device being controllable in response to this signal. The provision of adequate sensors and control units for controlling the second device, which applies the cover layer, allow and ecological and effective application of the cover layer.

Furthermore, means suitable for applying at least one further print layer to a third area may be arranged downstream of the first device and upstream of the second device when seen in the conveying direction. The application of a plurality of print layers below the cover layer allows the production of a great variety of print images, which may also consist of more than one layer.

DETAILED DESCRIPTION

Figure 1:
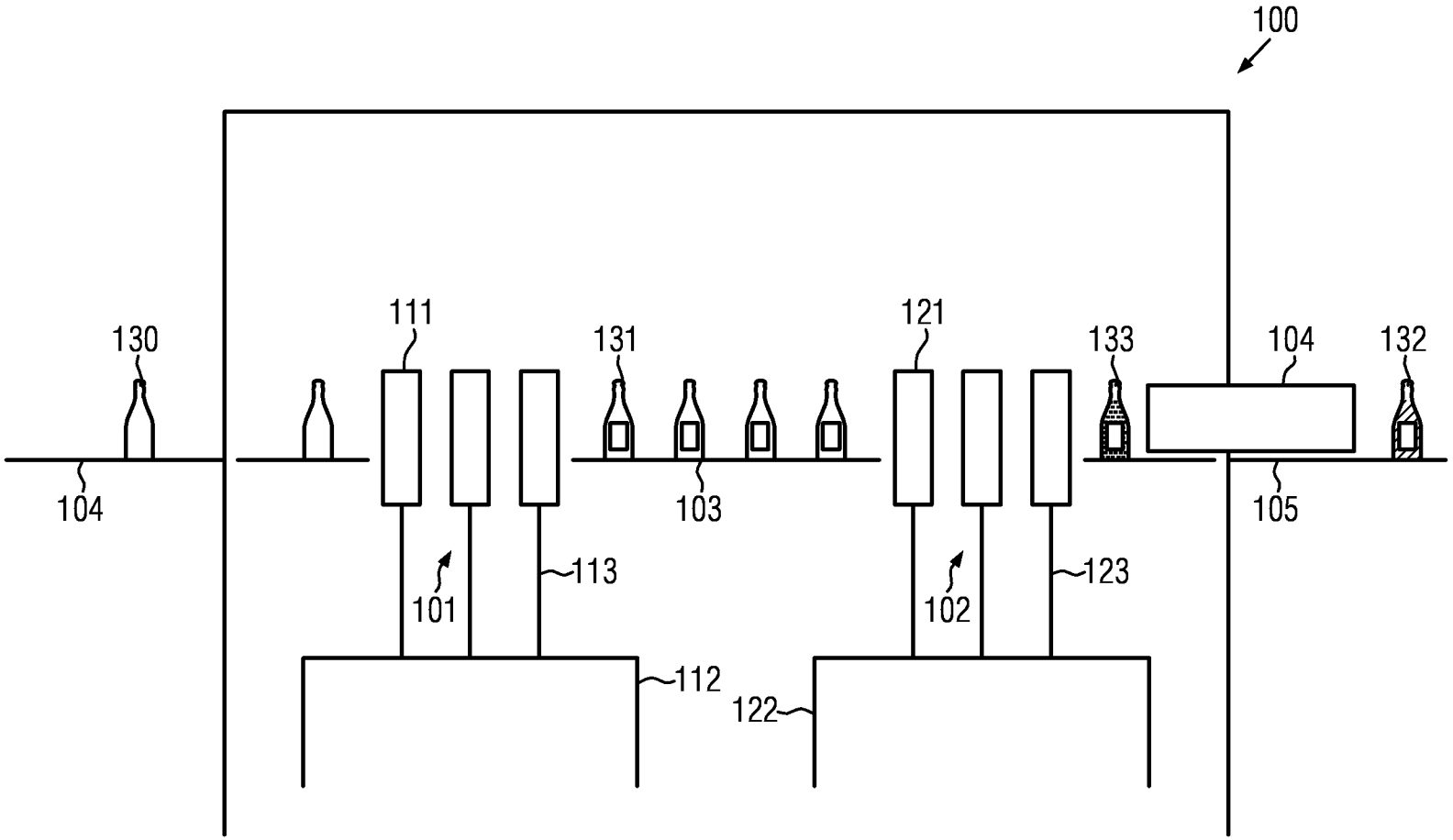
FIG. 1 shows a schematic representation of a printing machine according to the present disclosure.

FIG. 1 shows a schematic representation of a direct printing machine 100 according to the present disclosure. This machine comprises e.g. a feed conveyor 104 on which unprinted containers, such as bottles, 130, are conveyed to the machine 100. The containers may, in principle, consist of an arbitrary material. For example, the containers or bottles may be made of glass or plastic materials. Preferably, the containers are made from PET. In the machine 100, printing units 111 are arranged. Fundamentally, at least one printing unit is provided according to the present disclosure. A plurality of printing units may, however, be provided as well. The printing units 111 define in common the first device, in which the unprinted containers 130 have print layers printed thereon. To this end, the printing units 111 of the first device 101 are connected e.g. via lines 113 to printing ink containers 112. The different printing units 111 may be configured as a direct printing device according to the prior art and may be suitable for applying print images of specific shapes and colors. The individual printing units 111 may here apply different printing inks and print images or they may apply identical printing inks to different locations or, in a plurality of layers, to identical areas of the container. The thus printed container 131 then leaves the first device 111 and is conducted e.g. via an additional conveyor 103 to the second device 102.

In this device, the cover layer is applied via additional treatment units 121. Since the cover layer may perhaps not be a substance or a mixture of substances corresponding to conventional printing inks, the treatment units 121 are specially suitable for applying the substances used for the cover layer. Also for this purpose, the treatment units 121 of the second device 102 are connected via lines 123 with storage tanks 122, in which the material or the mixtures of substances for the cover layer are stored. In the second device 102, the cover layer is applied via the treatment units 121 at least to areas which have previously been printed on in the first device 101, so that the print layer or the print layers are fully covered by the cover layer. The containers 133 which have thus been printed on and provided with the cover layer then leave the second device 102 via an additional conveyor.

Before printing has been finally completed, an irradiation unit 104 may be provided, the containers 133, which have been printed on and provided with the cover layer, being moved into and irradiated in said irradiation unit 104. This irradiation may e.g. change the chemical properties or the physical properties of the cover layer applied. It can, for example, be used for finally curing the cover layer. To this end, the irradiation unit 104 preferably emits radiation or light of a specific wave length. This may be radiation in the visible range (light) or in the invisible range, such as IR radiation or UV radiation. When the irradiation has been completed, the container 132 can be transferred to further devices. Transport can be achieved by, for example, a further conveyor 105.

Irrespectively of the here described specific embodiment of the printing machine or direct printing machine 100, it should be mentioned that said machine may generally be configured as a linear-type or a carousel-type machine.

Figure 2C:
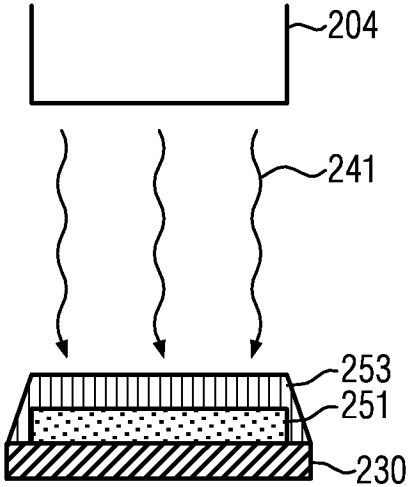
FIG. 2 shows a schematic representation of the printing process.
Figure 2B:
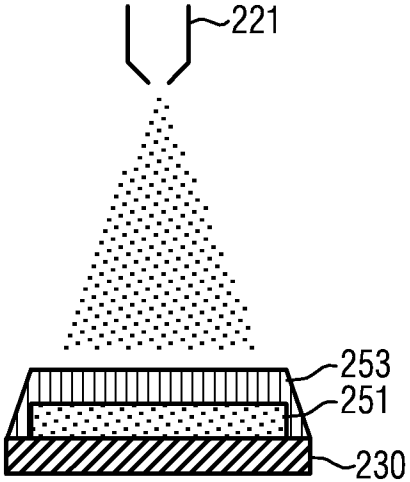
Figure 2A:
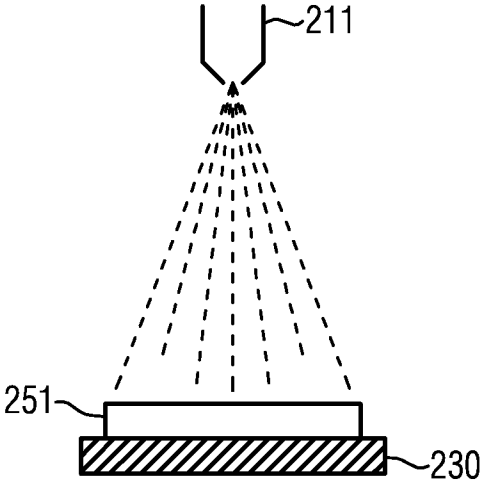

FIG. 2 shows a schematic representation of the process of printing on a container. To this end, FIG. 2 only shows a detail 230 of the container, which is here used as a substrate. In the first step, a print layer 251 is applied to the substrate 230. In comparison with the dimensions of the substrate, the print layer is here shown in a substantially enlarged fashion for reasons of illustration. Typical layer thicknesses lie in the range of a few micrometers up to a few ten micrometers. The print layer 251 may be applied e.g. via drop-on-demand methods through nozzles 211. Also other printing methods are here imaginable, e.g. rolling or spraying as well as dipping. The print layer thus applied preferably adheres to the substrate 230 or container surface of its own accord. Since a cover layer will be applied later on, this adherence need not be as permanent as that in the case of hitherto used direct printing methods.

In the next step, the cover layer 253 is applied in the second device which is shown in FIG. 1. This can again be done via one or a plurality of nozzles 221 and also according to the treatment methods described in connection with FIG. 3*a*. As can be seen, the cover layer 253 fully covers the print layer 251 and, in addition, it also covers parts of the substrate 230 which are located directly adjacent the edges of the print layer. The print layer 251 and the whole print image is thus fully encapsulated, whereby the print image will be protected against environmental influences, such as contact with water. Likewise, this encapsulation leads to additional fixing of the print layer, which means that the adherence of the print layer 251 to the substrate 230 will be intensified. The cover layer adheres preferably very well to the substrate 230. Basically, it is intended that the cover layer consists of a transparent and colorless material. It is therefore not primarily used for producing specific optical characteristics, but serves to coat and encapsulate the printing inks. It may, however, have specific material properties, such as a certain surface roughness, hardness or optical effects.

In a further method step, the substrate 230 with the print layer 251 and the cover layer 253 can then be irradiated with irradiation 241 from an irradiation source 204. This irradiation may e.g. be an input of heat energy or light energy, such as UV radiation or visible light. Such irradiation 241 may be used in the event that the cover layer 253 applied in the preceding step should, immediately after its application, not yet have the properties required. If the cover layer is applied e.g. with the aid of an inkjet process or screen printing or with the aid of plasma coating processes or e.g. by means of flame pyrolysis, a subsequent treatment may be necessary. For levelling e.g. irregularities in the cover layer in a controlled manner, the heat treatment may be used, whereby a smoother surface will be accomplished by superficially fusing and subsequently curing the cover layer. It is thus also guaranteed that the print layer 251 will preferably be covered by a cover layer 253 having the same thickness throughout its whole area. Furthermore, the degree of hardness of the cover layer may be changed through irradiation, using e.g. UV light, after application of the layer, so that specific demands on the cover layer can be fulfilled.

FIG. 3 shows schematically the execution of the direct printing method according to the present disclosure. In this context, it should be mentioned that, although at least two print images, which are identified as being different, are here always provided on the container, these print images may also consist of the same ink. In addition, superimposed printing of different print layers is not contradictory to the explanations given in connection with FIG. 2, since the print layer 251 shown in FIG. 2 can, according to the statements made in connection with FIG. 2, consist of a plurality of print layers that were applied through the printing units 111. In addition, it is also possible to apply only precisely one print layer.

Figures 3A, 3B, 3C:
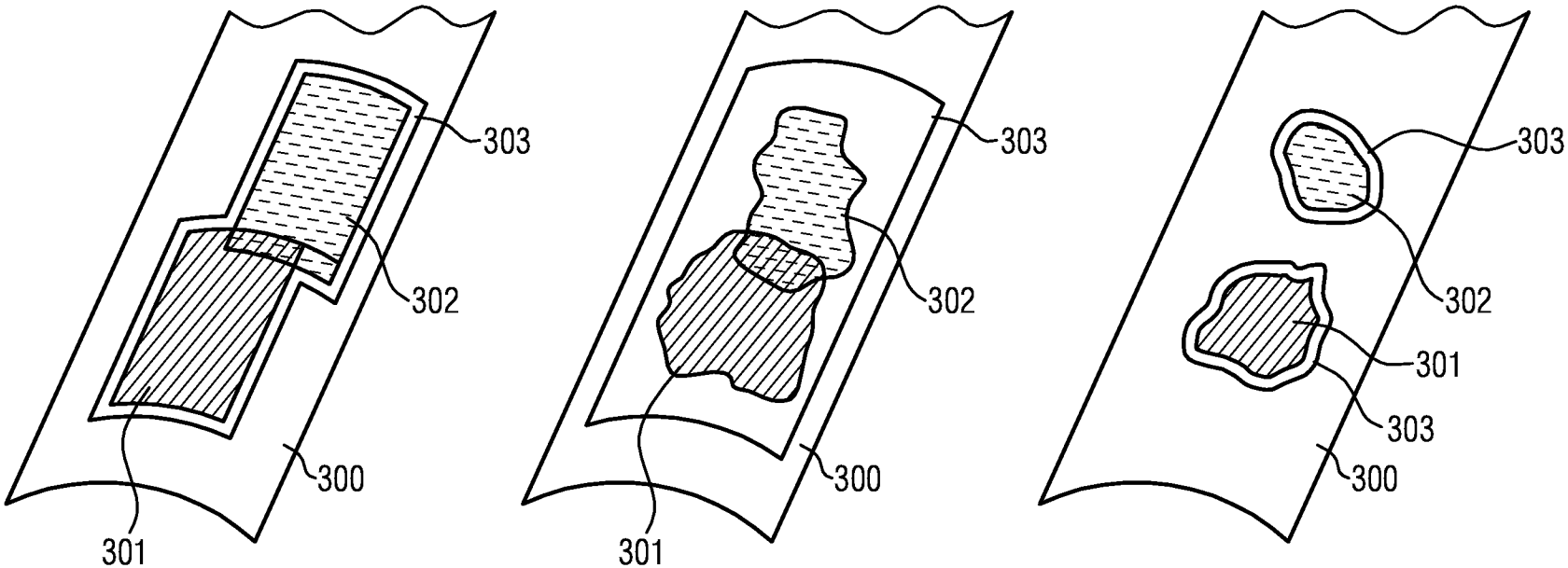
FIG. 3*a* shows a schematic representation of various embodiments of the print layers and of the cover layer.
FIG. 3*b* shows a schematic representation of various embodiments of the cover layers.
FIG. 3*c* shows a schematic representation of various embodiments of the print layer.

FIG. 3*a* shows a print image consisting of two rectangular print images 301 and 302 on the surface of a container 300. Due to the rectangular structure, it is technically easily possible to apply the cover layer such that it encloses the complete resultant print image, in particular the overlap of the print layers 301 and 302. As has already been described in FIG. 2, an overhang of the cover layer 303 is provided, which extends beyond the edges of the print image and is in direct contact with the surface of the container 300. In order to achieve this, the second device according to FIG. 1 is configured such that it prints on an area of the container which is larger than the area occupied by the print images 301 and 302, said larger area comprising at least the area of the print images and being, as shown, slightly larger than the latter.

FIG. 3*b* shows schematically a combination of two print images 301 and 302 having, in this case, an irregular shape on the container 300. For providing such an irregular print image with a cover layer, the whole container or a large area of the container surface 300 may be coated with the cover layer 303, the print images 301 and 302 being fully encapsulated in this area. Although this realization is not very effective from an ecological point of view, it definitely guarantees full encapsulation of the print layers 301 and 302. Furthermore, especially when the cover layer is fully applied to the container, no additional devices will be necessary for guaranteeing that the print layers are fully encapsulated by the cover layer.

FIG. 3*c* shows a further embodiment for covering a print layer 301 and a print layer 302 with a cover layer 303. Also in this case, the print layers 301 and 302 are each irregular in shape. Since it is advantageous from the ecological as well as from the economical point of view when the least possible amount of material is used for the cover layer, the cover layer according to this embodiment is applied such that only the print images 301 and 302 are covered and that a narrow region of the cover layer, which extends beyond the edges of the print layers 301 and 302, is in direct contact with the substrate, i.e. the container 300. In the case of irregular print images this, however, is more complicated from the technical point of view. Especially when printing methods are used, which produce different print images from one container to the next, this may become difficult. The device, e.g. according to FIG. 1, is here provided with sensors that are capable of measuring the positions and dimensions of the print images of 301 and 302, especially when irregular print images are used. On the basis of these measured values, a control unit may then control the second device, which applies the cover layer 303, such that the cover layer will only be applied in the area of the print images 301 and 302 and that an edge of the cover layer will be provided, the distance of a point on the edge of the print image 301 or 302 to the edge of the cover layer being identical for any point on the edge of the print image 301 and 302. This strip, which is shown in FIG. 3*c*, may e.g. have a width of approximately 1 mm, preferably of 0.5 mm, particularly preferred of 0.25 mm.

Since the cover layer is configured for being soluble in aqueous solutions having an pH value of less than 3 and/or higher than 10, suitable materials for such cover layers being e.g. polymers, a container printed on in this way will be particularly easy to recycle. Especially when the print layers or the printing inks used for these layers do not strongly adhere to the container, but are encapsulated and fixed to the container by the overlying cover layer, the cover layer and the print layers located therebelow can, when the container is shredded into plastic flakes, as is normally done in recycling processes, easily be removed from the plastic flakes in a suitable basic solution, since the disintegration of the container into plastic flakes and especially the use of a basic solution have the effect that the cover layer will be dissolved or at least broken open, and this will lead to dissolving of the print layers in the aqueous solution. The cover layer may also adhere very strongly to the print layer, so that the print layer may be entrained by the cover layer when the latter is separated from the container, and this can increase the efficiency of the recycling process still further. In addition, the cover layer may preferably consist of UV inks or water- and solvent-based lacquers. Also hot melt inks may be used here. Known primer materials of the type disclosed e.g. in DE 10 2010 044 243 A1 may be used as a cover layer as well. Also flame-pyrolytic layers consisting preferably of silicon oxide layers are advantageous. Depending on the material used, also the barrier properties of the container or at least of the area in which the cover layer is provided can be improved in this way. This applies especially to the diffusion of gases, such as oxygen or carbon dioxide, or of other substances, which should not penetrate into the material with which the container is filled.

The invention claimed is:

1. A direct printing method for printing on containers with the aid of a direct printing machine, comprising printing a print layer onto the container, in a first predefined area thereof, in a first device in a first step, and applying a cover layer to the container in a second device in a second step, the cover layer being applied to a second predefined area, which comprises the first predefined area and the surface area of which is larger than that of the first predefined area, the cover layer coalescing with the printing ink in the first predefined area thus creating a first connection, the cover layer coalescing with the container in parts of the second predefined area which differ from the first predefined area thus creating a second connection, and the first and second connections being insoluble in first aqueous solutions having a pH value between 3 and 10 and easily soluble in second aqueous solutions having a pH value in a range of less than 3 and/or higher than 10, wherein the second connection between the cover layer and the container is stronger than a connection between the print layer and the container and the first connection is stronger than the connection between the print layer and the container.

2. The direct printing method according to claim 1, and applying the cover layer to the second area with the aid of one of a rolling device, a flushing device, a spraying device, a dipping device, a direct printing device, a plasma coating device, and a flame pyrolysis device.

3. The direct printing method according to claim 1, the cover layer being easily soluble in the second aqueous solutions at a temperature of at least 75° C.

4. The direct printing method according to claim 1, the print layer being easily separated from the container in the second aqueous solutions.

5. The direct printing method according to claim 1, the second predefined area and the first predefined area being geometrically similar.

6. The direct printing method according to claim 5, the distance of a point on the edge of the first predefined area to the edge of the second predefined area being identical for any point on the edge of the first predefined area.

7. The direct printing method according to claim 1, such that, when exposed to radiation of a specific wavelength, the material of the cover layer reacts with a change of at least one of the properties adhesion strength, color, barrier properties, migration properties, and wherein the container is irradiated with radiation of this specific wavelength with the aid of an irradiation unit arranged downstream of the second device when seen in the conveying direction.

8. The direct printing method according to claim 1, and between the first step and the second step, at least one further print layer is applied to a third predefined area, the third predefined area being at least partially congruent with the first predefined area, or the third predefined area being different from the first predefined area, the first and the third predefined areas defining a printed region and the second predefined area comprising the printed region and the surface area of the second predefined area being larger than the printed region.

9. A direct printing machine for printing on containers, comprising a conveyor device for conveying the containers through the printing machine along a conveying direction, a first device for applying a print layer to a first predefined area of the container and a second device for applying a cover layer to a second predefined area of the container, the first device being arranged upstream of the second device when seen in the conveying direction, wherein the second device suitable for applying the cover layer to the second predefined area, the second predefined area comprising the first predefined area and the second predefined area being larger than the first predefined area wherein: the first device applies the print layer to the container establishing a connection between the print layer and the container, the second device applies the cover layer to the print layer establishing a first connection between the cover layer and the print layer and applies the cover layer to the container establishing a second connection between the cover layer and the container; and wherein the second connection between the cover layer and the container is stronger than the connection between the print layer and the container and the first connection is stronger than the connection between the print layer and the container.

10. The direct printing machine according to claim 9, the second device comprising one of a rolling device, a flushing device, a spraying device, a dipping device, a direct printing device, a plasma coating device, and a flame pyrolysis device, and such respective devices being capable of applying the cover layer.

11. The direct printing machine according to claim 9, the direct printing machine comprising an irradiation unit arranged downstream of the second device when seen in the conveying direction, the irradiation unit being capable of emitting radiation in a specific wavelength region and the material of the cover layer reacting to an irradiation with radiation in this specific wavelength region.

12. The direct printing machine according to claim 9, and means suitable for applying at least one further print layer to a third area are arranged downstream of the first device and upstream of the second device when seen in the conveying direction.

13. The direct printing method according to claim 1, the containers comprising bottles.

14. The direct printing machine according to claim 9, the container comprising bottles.

* * * * *